US007963693B2

(12) United States Patent
Genequand

(10) Patent No.: US 7,963,693 B2
(45) Date of Patent: Jun. 21, 2011

(54) MECHANICAL OSCILLATOR

(75) Inventor: Pierre-Marcel Genequand, Geneva (CH)

(73) Assignee: CSEM Centre Suisse d'Electronique et de Microtechnique SA-Recherche et Developpement, Neuchatel (CH)

( * ) Notice: Subject to any disclaimer, the term of this patent is extended or adjusted under 35 U.S.C. 154(b) by 152 days.

(21) Appl. No.: 12/372,091

(22) Filed: Feb. 17, 2009

(65) Prior Publication Data

US 2009/0207700 A1 Aug. 20, 2009

(30) Foreign Application Priority Data

Feb. 18, 2008 (CH) ..... 08101699

(51) Int. Cl.
*G04B 17/20* (2006.01)

(52) U.S. Cl. ..... 368/170; 368/127; 368/168; 368/169; 368/174

(58) Field of Classification Search ..... 368/168–171, 368/173, 174, 127, 128
See application file for complete search history.

(56) References Cited

U.S. PATENT DOCUMENTS 6,846,104 B2 * 1/2005 Geyer ..... 368/127
2006/0225526 A1 * 10/2006 Levingston ..... 74/1 SS

FOREIGN PATENT DOCUMENTS

CH 279 954 12/1951
EP 1 736 838 12/2006

OTHER PUBLICATIONS

European Search Report dated Nov. 7, 2008, from corresponding application.

* cited by examiner

*Primary Examiner* — Renee Luebke
*Assistant Examiner* — Jason Collins
(74) *Attorney, Agent, or Firm* — Young & Thompson

(57) ABSTRACT

The present invention concerns a mechanical oscillator, comprising an oscillating system comprising a balance (1) and its return spring (3). This oscillator also comprises two elastic strips (9, 10) fixed by one end and acting in opposition intermittently by their other end on a connecting organ (8) secured to the oscillating system.

14 Claims, 3 Drawing Sheets

MECHANICAL OSCILLATOR

TECHNICAL FIELD

The present invention relates to mechanical oscillators, in particular those which equip timekeepers. It more particularly concerns an oscillator of this type provided with a device for adjusting and correcting its frequency.

BACKGROUND OF THE INVENTION

The conventional oscillators which equip mechanical timekeepers traditionally comprise a spring or balance-spring element making it possible to return a regulator or balance element to the neutral position. The energy dissipated by the oscillation is offset by the application of a drive torque provided by a loading spring, or a barrel spring. However, this drive torque exerted by the barrel spring varies over time according to the load (or degree of winding) of the latter part and, in most mechanical timekeepers, in particular when the barrel is coupled directly to the trains of the drive train, this variation has the effect of modifying the oscillation amplitude as well as, to a certain extent, the period of the oscillator. A modification of this type may translate, for certain embodiments, to a deviation from one to several tens of seconds per day.

In order to offset the effect of the variation of intensity of the drive torque, it was proposed to use a device called "fusee" (see the "Dictionnaire professionnel illustré de l'horlogerie" by G. A. Berner), which makes it possible to equalize the driving-power transmitted to the train by the barrel spring. However, a device of this type is difficult to miniaturize, and for this reason cannot actually be applied in mechanical watches.

Another corrective device was described in relation with FIG. 7 of European patent application EP 1 736 838 in the applicant's name. In this document, it is proposed to have the drive torque of the barrel spring act on a flexible organ, which controls the active length of an element which participates in the oscillation-constant of the mechanical oscillator. As in the case of the fusee, such a device is not easy to implement.

Also known from patent CH 279 954 is a mechanical oscillator comprising an oscillating system formed by a balance and its return spring and a frequency correction device. The corrector is based on controlling the active length of the return balance-spring by a mechanism controlled directly by the rotation of the winding pivot of the mainspring, which depends on the drive torque.

However, none of these corrective devices allow one to take variations in torque due to friction existing, for example, at the different parts, including the oscillator as well as the trains transmitting the drive torque to the latter, into account.

In quasi-permanent oscillation regime, i.e. when the intensity of the drive torque varies sufficiently slowly in relation to the oscillation period, one can allow that the period variation caused is equivalent to that which would be caused by a non-linear return torque according to the deflection. This type of isochronism defect can be corrected by a non-linearity which is the reverse of the return spring.

BRIEF SUMMARY OF THE INVENTION

A first aim of the invention is to provide an oscillator for mechanical watch provided with means for correcting the isochronism defect caused by the variations of the drive torque of the barrel spring, taking into account the effective drive torque variations due to friction in different parts of the oscillator and of the transmission train, according to a principle of correction according to the amplitude.

More generally, the aim of the invention is to be able to maintain a constant frequency of the oscillator, in its useful operating range, based on the amplitude variations in order to correct an effect which can be likened to a non-linearity of the return spring.

Concretely, the present invention concerns a mechanical oscillator of the type comprising an oscillating system mounted on a frame and comprising a balance and its return spring. This oscillator also comprises a frequency correction device formed by at least first and second elements fixed to said frame and to the oscillating system, respectively, the first of these elements comprising a flexible elastic strip fixed by one of its ends and the second being a connecting organ weighing, during part of the oscillation, against the free end of said strip.

The oscillator according to the invention may comprise only one flexible strip but, advantageously, it comprises two acting in opposition on the connecting organ and offset, in relation to each other, by a half-vibration of the oscillation, in order to symmetrize the characteristic of the return correction according to the deflection.

In both cases, the single strip—or the two strips—is fixed—or are fixed—to the frame via an interface allowing a position adjustment in translation and in rotation.

According to a first position adjustment, the single blade—or the two blades—is—or are—in contact, according to a non-zero pressure, with the connecting organ when the balance is in the neutral position, i.e. when its angle in relation to its idle position is equal to zero, so as to obtain an increase in the frequency when the amplitude decreases (negative correction).

According to a second position adjustment, the single strip—or the two strips—is not—or are not—in contact, according to a non-zero pressure, with the connecting organ when the balance is in the neutral position, so as to obtain an increase of the frequency when the amplitude increases (positive correction).

The connecting organ can be fixed to the balance either directly, or via an intermediate part of the return spring oscillating according to a deflection angle reduced in relation to that of the balance.

The oscillator can advantageously include a fixed stop located across from the connecting organ for a deflection angle of the balance in relation to its idle position equal to zero, and designed to exert a pre-stressing on said strip when said connecting member is not in contact.

BRIEF DESCRIPTION OF THE DRAWINGS

Other objects, characteristics and advantages of the present invention will be better understood upon reading the following description of particular embodiments, this description being provided purely for information and in relation to the attached drawings in which.

DETAILED DESCRIPTION OF THE INVENTION

Figure 1:
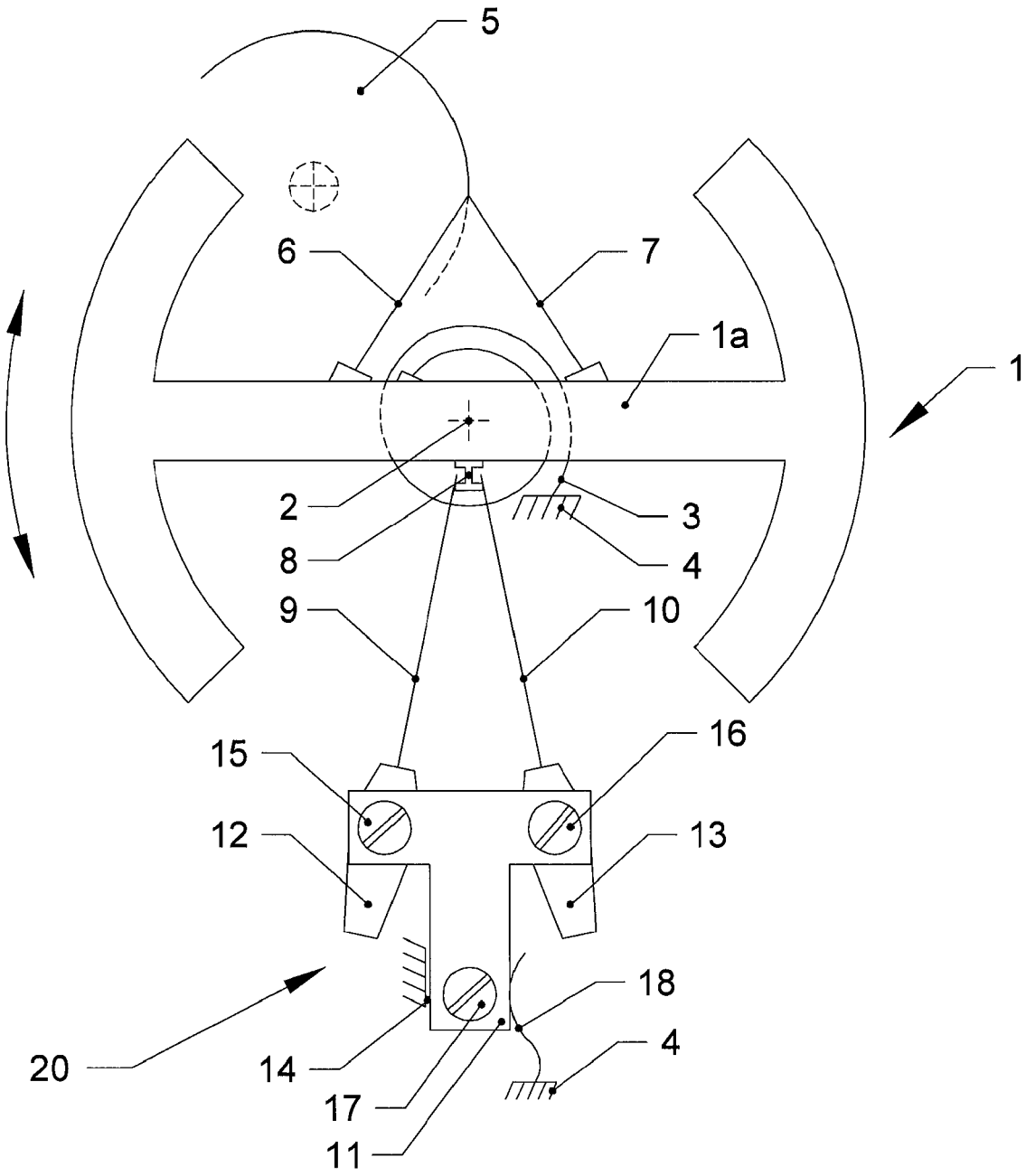
FIG. 1 is a schematic diagram of an oscillator according to the invention, with the correction device acting directly on the balance.

The oscillator for mechanical watch according to the invention is particularly applicable to the escapement system described in document EP 1 736 838, already cited, in particular to FIG. 2*a,* the content of which is integrated into this description. One recognizes an oscillating system comprising a balance 1 (partially illustrated) oscillating around its axis 2 and its return spring, or balance spring, 3 fixed between the arm 1*a* of the balance and the frame 4 of the watch.

An escapement wheel 5 receives the drive torque dispensed by a barrel spring via a train (not shown). This drive torque is transmitted to the oscillating system in order to drive the oscillation by two elastic strips 6 and 7 connected to the arm 1*a* of the balance 1 by one end and the other end of which, or pallet-stone, engages in the teeth (not shown) of the escapement wheel 5.

While oscillating, under the impulse of a drive torque dispensed by a barrel spring, the oscillating system (balance 1 and balance spring 3) controls the rotation of the escapement wheel 5 at a rhythm which must be as constant as possible, as it determines the precision of the watch it controls. However, as previously mentioned, mechanical watches, and more particularly those equipped with an escapement system as just described, suffer from an isochronism defect which can translate to a deviation of some ten seconds per day for a drive torque variation of ten percent, corresponding to an amplitude variation of five percent. Such a deviation is due to the fact that, contrary to free escapement systems, such as those called Swiss pallet systems, the particular pallet of the aforementioned EP document is, via its elastic strips, in permanent contact with the escapement wheel 5. During its discharge, the drive torque of the barrel spring decreases, which causes a corresponding decrease of the oscillation amplitude of the oscillator (in order to maintain balance with the dissipated power) and also of its frequency through the effect of the permanent contact. For small variations, corresponding to the operating range, one can allow that the frequency varies linearly with the variations of the drive torque.

The principle of the invention consists of providing the oscillator with a correction device 20 having a frequency characteristic opposite its own in the operating range.

To this end, the correction device 20 comprises two elastic strips 9 and 10 which press, in opposition, on a connecting organ or stop 8, which is T-shaped, connected to the arm 1*a* of the balance 1, closest to its center of rotation. These elastic strips 9 and 10 are, via catches 12 and 13, connected, by their other end, to a fixing and adjustment interface 11 thanks to set screws 15 and 16, respectively.

The interface 11, secured to the frame 4 by a screw 17, can be positioned in relation to the axis 2 of the balance by moving it along a slide bar 14 of the frame against which it is applied under the action of a spring 18.

The interface 11 makes it possible to adjust the position of the point of support of the elastic strips 9 and 10 on the connecting organ 8 and, therefore, their effective length and their stiffness. The catches 12 and 13 make it possible to adjust the orientation of these elastic strips in relation to the stop and thereby to adjust the deflection angle of the balance in relation to its idle position for which they come into contact with or leave this same stop. The position adjustment thereby makes it possible to adjust the amplitude of the frequency variation, while the contact angle adjustment makes it possible to adjust the useful deflection range as well as the sign of non-linearity.

According to the embodiment of FIG. 1, for small amplitudes of the balance, the two elastic strips 9 and 10 are in contact with the stop 8 and they constitute an additional spring which acts on the balance as a complement to the balance spring 3. If the amplitude of the oscillations increases, there comes a moment when one of the strips ceases to be in contact with the stop, thereby modifying the elastic constant of the global return spring. This creates a negative non-linearity (i.e., a loss of slope) in the response of this global return spring, as will be explained below with regard to FIG. 2, and it is this non-linearity which makes it possible to offset the abovementioned positive isochronism defect (i.e. a frequency which increases when the amplitude increases).

If one considers an elastic strip whereof the end is found on the path of the trajectory of an oscillating stop, the strip being substantially perpendicular to this trajectory, when the deflection D goes through a value $\phi_0$ (point A or B of FIG. 2), the strip can either come into contact with the stop (the additional spring becomes active in parallel with the balance spring), or leave it (the additional spring becomes inactive). The result is a break of the return (or non-linearity) characteristic. According to the relative importance of the active and inactive phases during the oscillation, the effect of the strip(s) will make itself more or less felt, which affects the average stiffness throughout the duration of oscillation, and therefore the frequency of oscillation.

In the case of the aforementioned EP document, the frequency of the oscillator decreases when the maintenance torque and the oscillation amplitude decrease. It is therefore appropriate to apply a negative compensation, i.e. to produce an average return stiffness which is weaker at stronger amplitudes.

Figure 2:
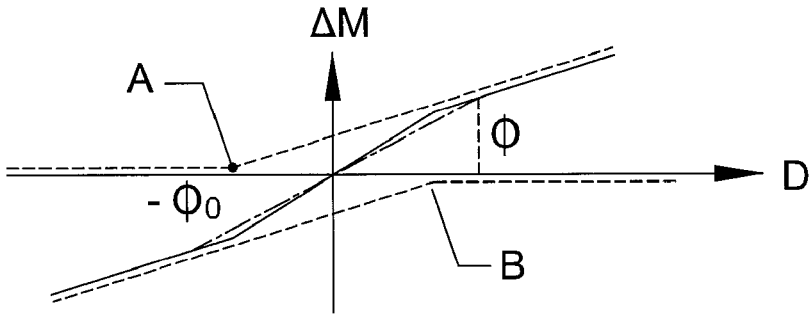
FIG. 2 shows a curve of the correction moment of the oscillator according to the deflection angle, for a negative correction.

FIG. 2 shows the curve of the additional return moment created by the strips according to the deflection angle of the balance in relation to its idle position, i.e. the variation of the torque $\Delta M$ according to the deflection D. In this figure, the upper curve in dotted line relates to the strip 10, the lower dotted curve relates to the strip 9 and the curve in solid line relates to the combined effect of the two strips.

For small deflections, or between the contact limit angles A and B, the overall curve according to the deflection has a slope of $2.\Delta K$ (K being the elastic constant of the global return spring) due to the action of the two elastic strips 9 and 10 added to that of the balance spring 3. For a deflection beyond the point B or below the point A, the slope of the response curve is then only $\Delta K$, which corresponds to the fact that there is then only a single elastic strip (9 or 10) bearing on the stop 8.

In the deflection interval A-B, the slope $2.\Delta K$ is constant. When the oscillation of the balance is within this interval, the frequency variation $\Delta f$, relative to the frequency f in the absence of the corrector device, is therefore constant and is equivalent to $\Delta f = f.\Delta K/K$. When the oscillation amplitude exceeds the interval A-B, the torque correction $\Delta M$ according to the deflection is no longer linear and the average slope is between $2.\Delta K$ at the small amplitudes and $\Delta K$ at the large amplitudes. The corresponding frequency variation goes from $\Delta f = f.\Delta K/K$ at the small amplitudes to $\Delta f = f.\Delta K/2.K$ at large amplitudes. The useful correction zone is in the vicinity of, but outside, the interval A-B.

When the barrel spring discharges, the oscillation amplitude decreases and the correction frequency variation $\Delta f$ increases, which makes it possible to offset the frequency decrease which the uncorrected oscillator would present under the influence of the drive torque.

Concretely, if one has a balance with angular inertia $I=2.5\ 10^{-9}$ kg.m$^2$, corresponding to a diameter of 10 mm for a mass of 0.1 gr, oscillating at the frequency f of 10 Hz, this determines a return constant $K=4.\pi^2.f^2.I=10^{-5}$ Nm$^2$/radian. The oscillation amplitude $\phi$ depends on the degree of winding of the barrel spring. If one assumes an amplitude of the oscillator of 35° when the barrel spring is fully wound and an amplitude of 30° when it is discharged, this corresponds to an amplitude variation of approximately 15% and a variation of the maintenance moment in the vicinity of 30%. One will posit that $\phi_0$ corresponds to the amplitude of the points A and B and will approximate the correction by an equivalent linear spring whereof the return torque $\Delta K_{equ}$ depends on the amplitude $\phi$ according to the following formulas (curves in dotted lines):

$$\Delta K_{equ}=2.\Delta K, \text{ for } \phi<\phi_0,$$

$$\Delta K_{equ}=\Delta K(1+\phi_0/\phi), \text{ for } \phi\geqq\phi_0,$$

where $\Delta K$ represents the angular rigidity of a strip bearing on its stop. This expression has the merit of representing the correction fairly well, while remaining very simple. The sensitivity to the correction $\Delta K_{equ}/\Delta K$ is higher when the amplitude $\phi$ is close to $\phi_0$.

Taking the values $\phi=35°$ and $\phi_0=30°$, this gives:

$$\Delta K_{equ}(30°)-\Delta K_{equ}(35°)=0.14K.$$

This value makes it possible to calculate the relative frequency correction:

$$d(\Delta f)/f=d(\Delta K_{equ})/2K=0.07.\Delta K/K.$$

We will assume that the operating variation to be corrected has been measured at 5 sec/day per degree of amplitude, i.e. 25 sec/day for 5 degrees. In relative frequency, this gives:

$$d(\Delta f)/f=-25/86'400=-3\ 10^{-4}.$$

It must be expressed that the sum of the two preceding values is zero, i.e. that the correction offsets the error. One then obtains:

$$0.07.\Delta K/K-3\ 10^{-4=0}, \text{ from which } \Delta K=4.3\ 10^{-3}.K=4.3\ 10^{-8} \text{ Nm/radian.}$$

If one express $\Delta K$ according to the strip parameters, one can write:

$$\Delta K=((E.b.h^3)/(4.L^3)).R^2_{but},$$

where E is the Young module, b is the width of the strip, h is its thickness, L is the useful length and $R_{but}$ is the pivot radius of the stop. Typically, E is equal to 200,000 N/mm$^2$ (for steel), b is in the vicinity of 0.5 mm, L is equivalent to 8 mm and $R_{but}$ equals 1 mm. One can therefore infer from this, using the preceding formulas, that the thickness h of the strip is in the vicinity of $10^{-5}$ m. A strip of this type can be cut into a sheet 10 microns thick and folded to allow fixing.

Figure 3:
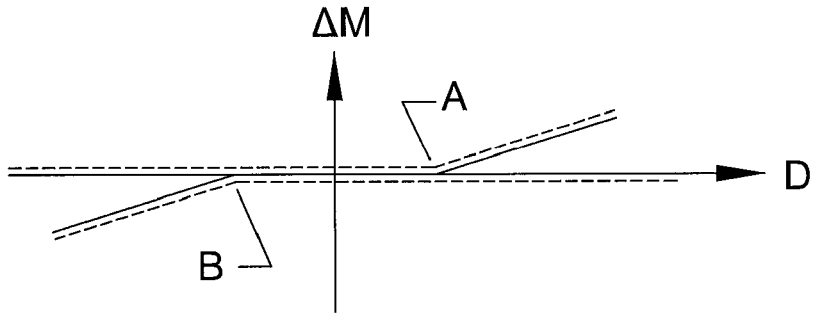
FIG. 3 shows a curve of the correction moment of the oscillator according to the deflection angle, for a positive correction.

FIG. 3 illustrates a variation of adjustment of the orientation of the elastic strips, in which these are positioned such that they are not in contact with the stop when the balance is in the neutral position (deflection angle equal to zero) but come into contact for a deflection angle A or B. This means that $\Delta M$ is null in the range between A and B and of slope $\Delta M$ outside this range. As a result, the frequency variation $\Delta f$ is opposite that described above and therefore makes it possible to correct a negative dependence according to the drive torque.

The correction device according to the invention can operate with a single elastic strip. In this case, the global curve (solid line) of the torque $\Delta M$ combines with one of the two dotted curves of FIGS. 2 and 3. The response is dissymmetrical, the correction only taking place on a single vibration of the oscillation of the balance.

Figure 4:
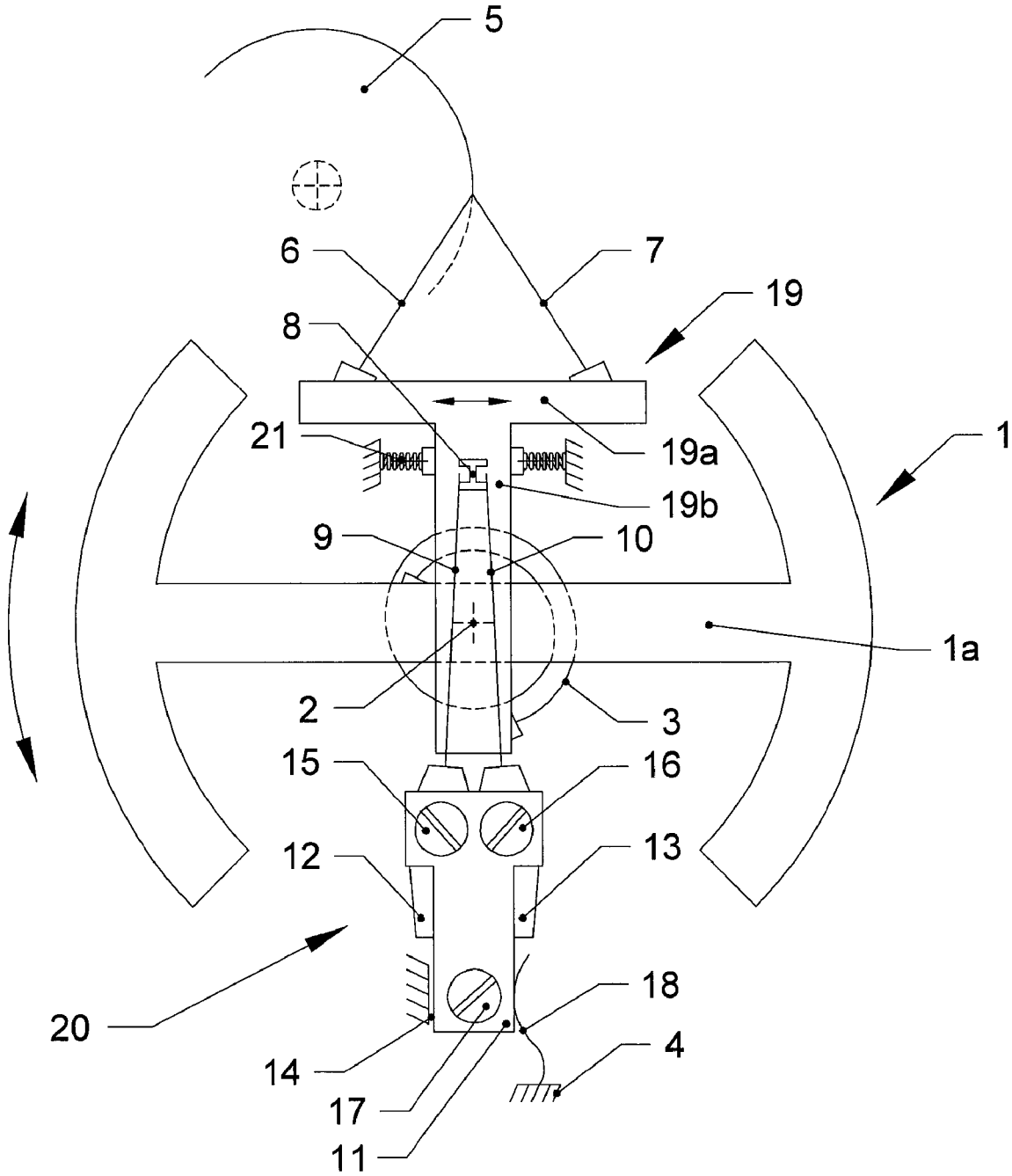
FIG. 4 is a schematic diagram of an oscillator according to the invention, with the correction device acting directly on an intermediate part oscillating at reduced amplitude.

According to still another variation, illustrated in FIG. 4, in which the elements shared with FIG. 1 have been designated using the same reference numbers, the connecting organ 8 is fixed, not on the balance 1, but on an intermediate part 19, which is T-shaped and serves as pallet, whereof the horizontal bar 19*a* (in the figure) is the base of the elastic strips 6 and 7 and whereof the vertical bar 19*b* (in the figure) is mounted, free to oscillate, on the axis 2 of the balance 1. The balance spring 3 is then fixed between the arm 1*a* of the balance and the vertical bar 19*b*, which is subject, moreover, to the action of two return springs 21, acting in opposition.

The arrangement of FIG. 4 has the result of reducing the oscillation angle of the pallet 19 in relation to that of the balance 1, which makes it possible, on one hand, to use stiffer strips and, on the other hand, to avoid excessive deformations and friction.

Figure 5:
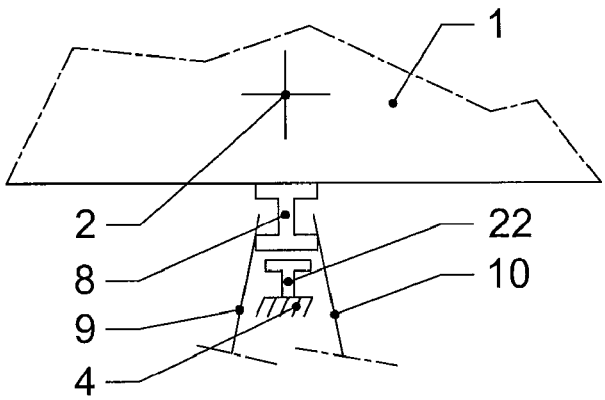
FIG. 5 illustrates a variation of the oscillator incorporating an additional stop.

FIG. 5 shows still another variation with a fixed stop 22 connected to the frame 4 across from the stop 8 for a deflection angle of the balance 1 in relation to its idle position equal to zero. This stop is used to connect and disconnect, under pre-stressing, the elastic strips 9 and 10 from the mobile connecting member 8.

Figure 6:
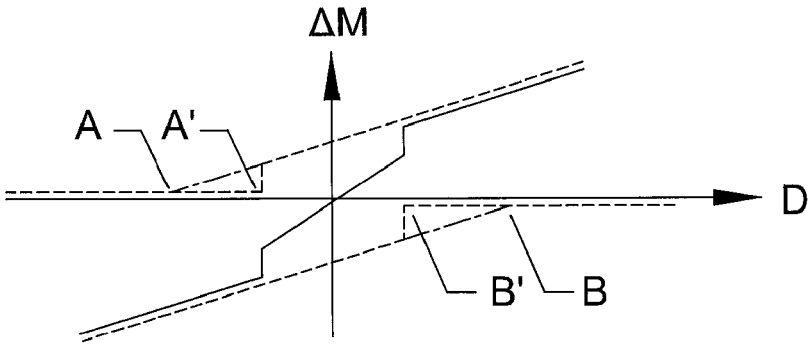
FIG. 6 shows a curve of the correction moment of the oscillator of FIG. 5 according to the deflection angle.

As shown in FIG. 6, comparable to FIGS. 2 and 3, such an arrangement makes it possible to change the position of the points A and B into A' and B', while adding a jump to the slope change, which allows better optimization of the deflection range and the frequency variation range. This arrangement also makes it possible to avoid the appearance of parasite oscillations of the strips during their disconnection.

Thus is proposed an oscillator, advantageously usable in a mechanical timekeeper, which is provided with means for correcting an isochronism defect caused by variations of the drive torque. The correction done is more effective when the amplitude-isochronism defect relationship is stable, which is the case for an elastic suspension balance such as, for example, that of FIG. 5 of document EP 1 736 838, already cited.

The invention claimed is:

1. A mechanical oscillator comprising an oscillating system, mounted on a frame and comprising a balance and its return spring, said oscillator further comprising a frequency correction device, wherein said frequency correction device comprises at least first and second elements fixed to said frame and said oscillating system, respectively, the first of these elements comprising at least one flexible elastic strip fixed by one of its ends and the second being a connecting organ weighing, during part of each oscillation, against the free end of said strip.

2. The oscillator according to claim 1, wherein said strip is in contact, according to a non-zero pressure, with said connecting organ for a deflection angle of the balance in relation to its idle position equal to zero.

3. The oscillator according to claim 1, wherein said strip is not in contact with said connecting organ for a deflection angle of the balance in relation to its idle position equal to zero.

4. The oscillator according to claim 1, wherein the first of said elements comprises two elastic strips acting in opposition bearing on the connecting organ and offset, in relation to each other, by a half-vibration of the oscillation.

5. The oscillator according to claim 4, wherein said strips are in contact, according to a non-zero pressure, with said connecting organ for a deflection angle of the balance in relation to its idle position equal to zero.

6. The oscillator according to claim 4, wherein said strips are not in contact with said connecting organ for a deflection angle of the balance in relation to its idle position equal to zero.

7. The oscillator according to claim 1, wherein said connecting organ is fixed directly to said balance.

8. The oscillator according to claim 1, wherein said connecting organ is fixed to said oscillating system by an intermediate part of the return spring oscillating according to a deflection angle reduced relative to that of the balance.

9. The oscillator according to claim 1, wherein it comprises a fixed stop located across from the connecting organ for a deflection angle of the balance in relation to its idle position equal to zero, and designed to exert a pre-stressing on said strip when said connecting member is not in contact.

10. The oscillator according to claim 1, wherein said elastic strip is fixed to the frame via an interface allowing adjustment of its position in translation and in rotation.

11. A mechanical oscillator, comprising:

a frame;

an oscillating system, mounted on the frame and comprising a balance and a return spring; and, a frequency correction device, said frequency correction device comprising a first element fixed to said frame and a second element fixed to said oscillating system, the first element comprised of a pair of elastic strips having first ends fixed to said frame, the elastic strips each having a free end, the second element being a connecting organ connected to the balance, the free ends of each of the pair of elastic strips pressing, in opposition, on the connecting organ during a part of each oscillation, the elastic strips functioning as an additional spring on the balance.

12. The oscillator according to claim 11, wherein said connecting organ is fixed to said oscillating system by an intermediate part of the return spring oscillating according to a deflection angle reduced relative to that of the balance.

13. The oscillator according to claim 11, further comprising a fixed stop located across from the connecting organ for a deflection angle of the balance in relation to its idle position equal to zero, and designed to exert a pre-stressing on said strip when said connecting member is not in contact.

14. The oscillator according to claim 11, wherein said elastic strip is fixed to the frame via an interface allowing adjustment of its position in translation and in rotation.

* * * * *